US006684139B1

(12) United States Patent
Kirat et al.

(10) Patent No.: US 6,684,139 B1
(45) Date of Patent: Jan. 27, 2004

(54) DEVICE AND METHOD FOR CONTROLLING ACTUATING DEVICES FOR THE ACTIVE SUSPENSION OF VEHICLES, IN PARTICULAR TRAINS

(75) Inventors: Regis Kirat, Le Creusot (FR); Jean-Pierre Pascal, Paris (FR); Jean-Louis Maupu, Villejuif (FR); Patrice Aknin, Arcueil (FR)

(73) Assignees: Alstom Transport SA, Paris (FR); Institut National de Recherche sur les Transports et leur Securite, Cedex (FR)

( * ) Notice: Subject to any disclaimer, the term of this patent is extended or adjusted under 35 U.S.C. 154(b) by 0 days.

(21) Appl. No.: 09/355,406

(22) PCT Filed: Dec. 30, 1997

(86) PCT No.: PCT/FR97/02455

§ 371 (c)(1),
(2), (4) Date: Mar. 14, 2000

(87) PCT Pub. No.: WO98/29288

PCT Pub. Date: Jul. 9, 1998

(30) Foreign Application Priority Data

Jan. 2, 1997 (FR) ..... 97 00011

(51) Int. Cl.[7] ..... B61F 5/24
(52) U.S. Cl. ..... 701/37
(58) Field of Search ..... 701/1, 19–26, 701/36–37, 48, 91–93, 124; 180/116–119, 172, 175–179, 199–201, 21–24, 24.03–24.04, 24.07–24.09, 271, 282, 449; 280/5.5, 5.508, 5.512–5.515, 401–407.1, 423.1–424; 105/1.4, 3, 4.1–4.4, 167, 175.1; 104/2–17.2

(56) References Cited

U.S. PATENT DOCUMENTS

| | | | | | |
|---|---|---|---|---|---|
| 3,902,691 | A | * | 9/1975 | Ott | 246/167 R |
| 3,911,830 | A | | 10/1975 | Adams | |
| 4,428,296 | A | * | 1/1984 | Scheuchzer et al. | 104/2 |
| 4,954,957 | A | * | 9/1990 | Kawagoe et al. | 701/48 |
| 5,189,920 | A | * | 3/1993 | Martinez | 73/865.3 |
| 5,564,342 | A | * | 10/1996 | Casetta et al. | 105/199.2 |
| 5,640,910 | A | * | 6/1997 | Pouyt et al. | 105/168 |
| 5,787,815 | A | * | 8/1998 | Andersson et al. | 105/199.2 |

FOREIGN PATENT DOCUMENTS

| | | |
|---|---|---|
| EP | 0 466 449 A1 | 1/1992 |
| EP | 0 692 421 A1 | 1/1996 |

* cited by examiner

*Primary Examiner*—Thu Nguyen
(74) *Attorney, Agent, or Firm*—Sughrue Mion, PLLC

(57) ABSTRACT

The present invention relates to a control method and control apparatus for controlling actuator apparatus implemented in active suspension apparatus for vehicles, in particular rail vehicles, said control method and said control apparatus being characterized in that they use the articulated architecture of the train to derive the local curvature of the track in real time, in which control method and control apparatus the control signal transmitted by said control apparatus to the actuator apparatus of the bogie of order n in the articulated train is a function of measurements of at least one deflection angle $\alpha_i$ at an articulation center situated between adjacent carriages and of the position offset $h_j$ of said articulation center relative to the track.

10 Claims, 1 Drawing Sheet

DEVICE AND METHOD FOR CONTROLLING ACTUATING DEVICES FOR THE ACTIVE SUSPENSION OF VEHICLES, IN PARTICULAR TRAINS

BACKGROUND OF THE INVENTION

The present invention relates generally to relationships for controlling active suspension apparatus for vehicles, in particular rail vehicles, and more particularly to a method and apparatus for controlling actuator apparatus for active suspension of vehicles, in particular rail vehicles.

The following description relates to actuator apparatuses implemented in prior art active suspensions for rail vehicles.

Such actuator apparatuses, e.g. hydraulic, pneumatic, or electric actuators, are associated with transverse or vertical secondary suspension systems on rail vehicles to obtain a more comfortable ride.

A first prior art solution, implemented by Fiat in tilting trains ETR450, ETR460, and ETR470 now in commercial service, is characterized by the use of pneumatic actuators acting in parallel with the secondary suspension to as to perform body-bogie re-centering on curves taken at very high speed.

This re-centering is necessary because of the architecture of the Fiat tilting bogie in which the tiltable bolster (i.e. cross-member) is situated above the secondary suspension.

Another prior art solution is implemented by SGP from the Siemens Group, and was presented at the $28^{th}$ "Moderne Schienenfahrzeuge" rail conference in Graz, Austria, in October 1993.

That solution includes apparatus having actuators which may be pneumatic and which are disposed in parallel with the secondary suspension.

In such a solution, the control signal for controlling the actuator is essentially a function of the transverse offset between the body and the bogie as measured by a sensor.

Another prior art solution is implemented by Hitachi in the Shihkansen 400 and is described in the article published in the October 1992 edition of "Japanese Railway Engineering".

In addition, Hitachi's Document JP 8 048 243 which is applicable to the WIN350 prototype train describes implementing pneumatic or hydraulic actuators in parallel with the secondary suspension.

That prior art solution uses inertial sensors of the accelerometer type in the vehicle body.

The object of that document is to reduce vibration level to within a narrow frequency band.

Such vibration characterizes sustained yaw motion of the carriages.

Another prior art solution is implemented by Faiveley.

Documents FR 2 689 475 and FR 2 689 476 relate to that solution.

A prototype vehicle based on a main-line passenger car or "carriage" uses pneumatic cushions disposed horizontally between the body and the bogies and acting transversely.

The cushions are controlled so as to regulate the transverse position of the body relative to the bogie about a zero position.

Such regulation is however akin to servo-controlling position.

In such a solution, the control signals are generated on the basis of a single sensor for sensing transverse displacement between the body and the bogie.

From the actuator apparatus implemented in prior art active suspension apparatus on rail vehicles, it can be seen that it is known that actuator apparatuses can be disposed in parallel with the secondary suspensions of rail vehicles.

In addition, two modes of control are envisaged: a first mode consists in using the actuator under conditions in which position is servo-controlled, and a second mode consists in using the actuator under conditions in which force is servo-controlled.

From actuator apparatus implemented in prior art active suspension apparatus on rail vehicles, it can be seen that the most commonly used sensors are of the inertia type (accelerometers) and of the inductive type (measuring relative displacement and relative velocity, between two moving bodies).

SUMMARY OF THE INVENTION

An object of the invention is thus to improve the smoothness of the ride experienced by the passengers in articulated trains of vehicles, in particular of the very high speed train type, so as to enable such trains to operate at speeds higher than 350 km per hour while retaining the level of comfort currently observed on trains running at 300 km per hour.

This improvement must be obtained without providing additional apparatus relating to the track, e.g. apparatus for pre-recording track curves, smart beacons, etc.

The merit of the Applicant is to teach the use of a particular articulated train architecture to derive information that cannot be obtained by using known sensors and that can be used to control actuator apparatus.

In other words, the present invention consists in taking advantage of the articulated train architecture currently implemented in the Applicant's very high speed trains and in enabling the articulated train to be used as a track inspection vehicle to derive the local curvature of the track in real time.

According to the invention, the control apparatus for controlling actuator apparatus implemented in active suspension apparatus for vehicles, in particular rail vehicles, is characterized in that it uses the articulated architecture of the train to derive the local curvature of the track in real time.

The control apparatus of the invention for controlling actuator apparatus implemented in active suspension for vehicles also satisfies at least one of the following characteristics:

- the control signal transmitted by said control apparatus to the actuator apparatus of the bogie of order n in the articulated train is a function of measurements of at least one deflection angle $\alpha_i$ at an articulation center situated between adjacent carriages and of the position offset $h_j$ of said articulation center relative to the track;
- said actuator apparatus is force servo-controlled, said actuator apparatus setting the force applied to a vehicle body of an articulated train of vehicles from a bogie n associated with said body, said control apparatus delivering a general control signal, $signal_n$, for bogie n, that is a function of an intermediate parameter $\delta_n$ that is a function of at least one deflection angle $\alpha_i$ and of at least one position offset $h_j$ of said articulation centers relative to the track;
- said intermediate parameter $\delta_n$ for n>2 is given by the following formula:

$$\delta_n=\alpha_n/2+\alpha_{n+1}+(3\cdot h_{n+1}-2\cdot h_{n+2}-h_{n-1})/(2\cdot d)$$

where:

d is the distance between two articulation centers in the length direction;

$\alpha_n$ is the deflection angle of the articulation center at the bogie n; and $h_n$ is the position offset of the articulation center of the bogie n relative to the track;

for the second (n=2) bogie of the train, $\delta_2$ is given by the following formula:

$$\delta_2=\alpha_2/2+(2\cdot h_2-h_3-h_1)/(2\cdot d)$$

and for the first (n=1) bogie of the train, $\delta_1=0$; and said general control signal $signal_n$ for bogie n is given by the following formula:

$$signal_n = Gain1\cdot(V_{TMn} - V_{TVn}) + (V_x\cdot\delta_n)$$
$$= Gain1\cdot(d/dt(h_n) + V_x\cdot\delta_n)$$

where:

$V_{TMn}$ represents the transverse velocity of a point M belonging to the vehicle body and located at the articulation center;

$V_{Tvn}$ represents the transverse velocity of the point belonging to the track that, in the horizontal plane and when the train is stationary, coincides with the point M; and $V_x$ represents the velocity at which the train is advancing.

According to the invention, the method of controlling actuator apparatus implemented in active suspension apparatus for vehicles, in particular rail vehicles, is characterized in that it includes a step consisting in using the articulated architecture of the train to derive the local curvature of the track in real time.

The method of the invention for controlling actuator apparatus implemented in active suspension for vehicles also satisfies at least one of the following characteristics:

said control signal transmitted by said control apparatus to the actuator apparatus of the bogie of order n in the articulated train is a function of measurements of at least one deflection angle $\alpha_i$ at an articulation center situated between adjacent carriages and of the position offset $h_j$ of said articulation center relative to the track;

said actuator apparatus is force servo-controlled, said actuator apparatus setting the force applied to a vehicle body of an articulated train of vehicles from a bogie n associated with said body, said method including a step consisting in delivering a general control signal, $signal_n$, for bogie n, that is a function of an intermediate parameter $\delta_n$ that is a function of at least one deflection angle $\alpha_i$ and of at least one position offset $h_j$ of said articulation centers relative to the track;

said intermediate parameter $\delta_n$ for n>2 is given by the following formula:

$$\delta_n=\alpha_n/2+\alpha_{n+1}+(3\cdot h_{n+1}-2\cdot h_{n+2}-h_{n-1})/(2\cdot d)$$

where:

d is the distance between two articulation centers in the length direction;

$\alpha_n$ is the deflection angle of the articulation center at the bogie n; and $h_n$ is the position offset of the articulation center of the bogie n relative to the track;

for the second (n=2) bogie of the train, δ2 is given by the following formula:

$$\delta_2=\alpha_2/2+(2\cdot h_2-h_3-h_1)/(2\cdot d)$$

and for the first (n=1) bogie of the train, $\delta_1=0$; and said general control signal $signal_n$ for bogie n is given by the following formula:

$$signal_n = Gain1\cdot(V_{TMn} - V_{TVn}) + (V_x\cdot\delta_n)$$
$$= Gain1\cdot(d/dt(h_n) + V_x\cdot\delta_n)$$

where:

$V_{TMn}$ represents the transverse velocity of a point M belonging to the vehicle body and located at the articulation center;

$V_{Tvn}$ represents the transverse velocity of the point belonging to the track that, in the horizontal plane and when the train is stationary, coincides with the point M; and $V_x$ represents the velocity at which the train is advancing.

One advantage of the method and apparatus of the invention for controlling a force servo-controlled actuator is that performance is increased without requiring any increase in the numbers of sensors, of processing apparatuses, or of actuator apparatuses.

BRIEF DESCRIPTION OF THE DRAWINGS

Other objects, characteristics, and advantages of the invention appear on reading the following description of a preferred implementation of the method and apparatus for controlling a force servo-controlled actuator given with reference too the accompanying drawings, in which.

DETAILED DESCRIPTION OF THE INVENTION

Figure 1:
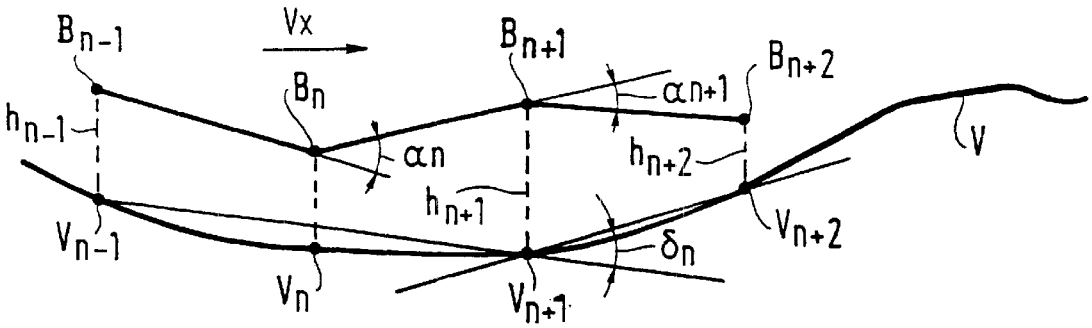
FIG. 1 shows a preferred method of the invention for deriving track curvature.

According to an essential characteristic of the invention, the control apparatus for controlling actuator apparatus implemented in active suspension apparatus for vehicles, in particular rail vehicles, uses the articulated architecture of the train to derive the local curvature of the track in real time.

For this purpose, the control signal transmitted by the control apparatus to the actuator apparatus of the bogie of order n in the articulated train is a function of measurements of a certain number of deflection angles at the articulation centers situated between adjacent carriages, and of the position offsets of the articulation centers relative to the track.

The combined use of measurements of at least one deflection angle $\alpha_i$ at an articulation center situated between adjacent carriages and of the position offset $h_j$ of said articulation center relative to the track upstream and downstream from the bogie n makes it possible to derive the local curvature of the track at the bogie n.

The method and apparatus of the invention for controlling actuator apparatus implemented in active suspension apparatus for vehicles, in particular rail vehicles, uses the articulated architecture of the train to derive the local curvature of the track in real time.

The control signal transmitted by the control apparatus to the actuator apparatus of the bogie of order n in the articulated train is a function of measurements of at least one deflection angle $\alpha_i$ at an articulation center situated between adjacent carriages and of the position offset $h_j$ of said articulation center relative to the track.

The actuator apparatus is force servo-controlled.

The actuator apparatus sets the force applied to a vehicle body of an articulated train of vehicles from a bogie n associated with the body, the control apparatus delivering a general control signal, $signal_n$, for bogie n, that is a function of an intermediate parameter $\delta_n$ that is a function of at least one deflection angle $\alpha_i$ and of at least one position offset $h_j$ of the articulation centers relative to the track.

The intermediate parameter $\delta_n$ for n>2 is preferably given by the following formula:

$$\delta_n=\alpha_n/2+\alpha_{n+1}+(3\cdot h_{n+1}-2\cdot h_{n+2}-h_{n-1})/(2\cdot d)$$

where:

d is the distance between two articulation centers in the length direction;

$\alpha_n$ is the deflection angle of the articulation center at the bogie n; and $h_n$ is the position offset of the articulation center of the bogie n relative to the track;

for the second bogie of the train (n=2), δ2 is given by the following formula:

$$\delta_2=\alpha_2/2+(2\cdot h_2-h_3-h_1)/(2\cdot d)$$

and for the first bogie of the train (n=1), $\delta_1=0$.

Simulation trials have made it possible to determine a general control signal in the following form:

$$signal_n=\text{Gain1}\cdot(V_{TMn}-V_{TVn+\Delta s})$$

where:

$V_{TMn}$ represents the transverse velocity of a point M belonging to the vehicle body and located at the articulation center; $V_{TMn}$ is generally obtained by integrating the transverse acceleration at the same point over time;

$V_{TVn}+\Delta s$ represents the transverse velocity of the track at a distance Δs ahead of the bogie of order n; and Gain1 is an adjustment parameter.

Means proposed to estimate the velocity $V_{Tvn+\Delta s}$ are given by the following formula:

$$V_{Tvn+\Delta s}=V_{TVn}+\delta_n\cdot V_x$$

where:

$V_{Tvn}$ represents the transverse velocity of the point belonging to the track that, in the horizontal plane and when the train is stationary, coincides with the above-mentioned point M; and $V_x$ represents the velocity at which the train is advancing.

The general control signal $signal_n$ is then obtained for bogie n, which signal is given by the following formula:

$$signal_n = Gain1\cdot(V_{TMn}-V_{TVn})+(V_x\cdot\delta_n)$$

$$= Gain1\cdot(d/dt(h_n)+V_x\cdot\delta_n)$$

FIG. 1 shows a preferred method of the invention for deriving track curvature.

As shown in FIG. 1 which shows the four articulation centers corresponding to the bogies B of ranks n−1 to n+2 in the articulated train, as well as the four points $V_n$ of the track V having the same abscissa values, the magnitude to be measured is the angle $\delta_n$ between the chords interconnecting the points of the track ($V_{n-1}$–$V_{n+1}$) and ($V_{n+1}$–$V_{n+2}$), the respective directions of which are treated as being the tangents to the curve at $V_n$ and in the middle of the segment ($V_{n+1}$–$V_{n+2}$).

The transverse distances between the articulation centers and the corresponding points of the track are assumed to be known by the sensors, as are the relative yaw angles $\alpha_n$ and $\alpha_{n+1}$ of the vehicle bodies. It is then easy to compute the angle $\delta_n$ to a first order as defined above.

Figure 2:
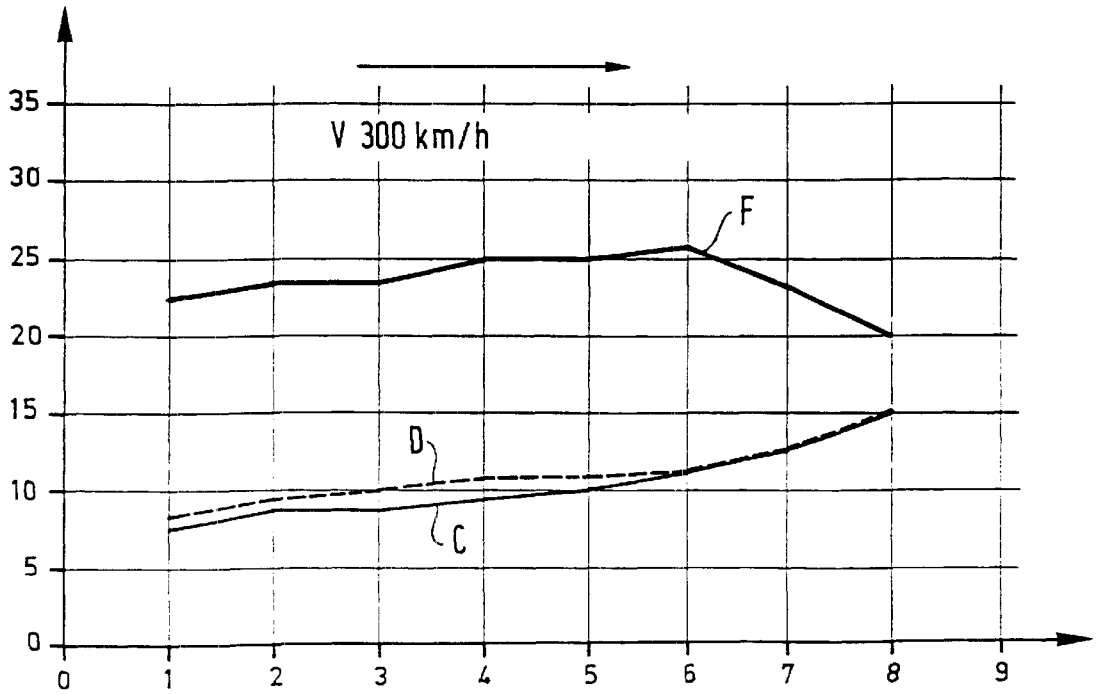
FIG. 2 shows the relative performance, in terms of comfort, for active transverse suspension apparatus achieved by implementing the method of the invention for deriving track curvature (curve F) in comparison with the performance obtained by prior art methods (curves C and D).

FIG. 2 shows the relative performance, in terms of comfort, for active transverse suspension apparatus achieved by implementing the method of the invention for deriving track curvature (curve F) in comparison with the performance obtained by prior art methods (curves C and D).

What is claimed is:

1. A control apparatus for controlling an actuator apparatus implemented in a suspension system of a vehicle, the vehicle comprising bodies articulated together and traveling on a track, the control apparatus comprising:

first means for accessing an articulated architecture of the vehicle;

second means for deriving a local curvature of the track in real time based on the articulated architecture of the vehicle; and third means for delivering a control signal to the actuator apparatus to control the suspension system of the vehicle based on the local curvature of the track derived by the second means.

2. Apparatus according to claim 1, wherein the control signal transmitted by said control apparatus to the actuator apparatus of a bogie of order n of the vehicle is a function of measurements of at least one deflection $\alpha_i$ angle at an articulation center situated between adjacent ones of said bodies of the vehicle and of the position offset $h_j$ of said articulation center relative to the track.

3. Apparatus according to claim 1, wherein said actuator apparatus is force servo-controlled, said actuator apparatus sets a force applied to at least one of the bodies of the vehicle from a bogie n associated with said at least one body, and the control signal is $signal_n$ for bogie n, and is a function of an intermediate parameter $\delta_n$ that is a function of at least one deflection angle $\alpha_i$ and of at least one position offset $h_j$ of an articulation center relative to the track, the articulation center being situated between adjacent ones of said bodies of the vehicle.

4. A control apparatus for controlling an actuator apparatus implemented in a suspension system of a vehicle, the vehicle comprising bodies articulated together and traveling on a track, the control apparatus comprising:

means for accessing an articulated architecture of the vehicle; and means for deriving a local curvature of the track in real time based on the articulated architecture of the vehicle, wherein the actuator apparatus is force servo-controlled and sets the force applied to at least one of the bodies of the vehicle from a bogie n associated with said at least one body, the control apparatus delivers a general control signal, $signal_n$, for bogie n, the $signal_n$ is a function of an intermediate parameter $\delta_n$ that is a function of at least one deflection angle $\alpha_i$ and of at least one position offset $h_j$ of an articulation center relative to the track, the articulation center being situated between adjacent ones of said bodies of the vehicle, said intermediate parameter $\delta_n$ on for n>2 is given by the following formula:

$$\delta_n=\alpha_n/2+\alpha_{n+1}+(3\cdot h_{n+1}-2\cdot h_{n+2}-h_{n-1})/(2\cdot d)$$

where:

d is the distance between two articulation centers in the length direction;

$\alpha_n$ is the deflection angle of the articulation center at the bogie n; and $h_n$ is the position offset of the articulation center of the bogie n relative to the track;

for the second (n=2) bogie of the vehicle, $\delta_2$ is given by the following formula:

$$\delta_2=\alpha_2/2+(2\cdot h_2-h_3-h_1)/(2\cdot d)$$

and for the first (n=1) bogie of the vehicle, $\delta_1=0$.

5. Apparatus according to claim 4, in which said general control signal $signal_n$ for bogie n is given by the following formula:

$$signal_n=\text{Gain1}\cdot(V_{TMn}-V_{TVn})+(V_x\cdot\delta_n)$$

$$=\text{Gain1}\cdot(d/dt(h_n)+V_x\cdot\delta_n)$$

where:

$V_{TMn}$ represents the transverse velocity of a point M belonging to the vehicle body and located at the articulation center;

$V_{TVn}$ represents the transverse velocity of the point belonging to the track that, in the horizontal plane and when the train is stationary, coincides with the point M; and $V_x$ represents the velocity at which the train is advancing.

6. A method of controlling an actuator apparatus implemented in a suspension system of a vehicle, the vehicle comprising bodies articulated together and traveling on a track, the method comprising:

accessing an articulated architecture of the vehicle;

deriving a local curvature of the track in real time based on the articulated architecture of the vehicle, wherein the actuator apparatus is force servo-controlled and sets the force applied to at least one of the bodies of the vehicle from a bogie n associated with said at least one body; and delivering a general control signal, $signal_n$, for bogie n, wherein the $signal_n$ is a function of an intermediate parameter $\delta_n$ that is a function of at least one deflection angle $\alpha_i$ and of at least one position offset $h_j$ of an articulation center relative to the track, the articulation center being situated between adjacent ones of said bodies of the vehicle, said intermediate parameter $\delta_n$ for n>2 is given by the following formula:

$$\delta_n=\alpha_n/2+\alpha_{n+1}+(3\cdot h_{n+1}-2\cdot h_{n+2}-h_{n-1})/(2\cdot d)$$

where:

d is the distance between two articulation centers in the length direction;

$\alpha_n$ is the deflection angle of the articulation center at the bogie n; and $h_n$ is the position offset of the articulation center of the bogie n relative to the track;

for the second (n=2) bogie of the vehicle, $\delta_2$ is given by the following formula:

$$\delta_2=\alpha_2/2+(2\cdot h_2-h_3-h_1)/(2\cdot d)$$

and for the first (n=1) bogie of the vehicle, $\delta_1=0$.

7. A method according to claims 6, in which said general control signal $signal_n$ for bogie n is given by the following formula:

$$signal_n=\text{Gain1}\cdot(V_{TMn}-V_{Tvn})+(V_x\cdot\delta_n)$$

$$=\text{Gain1}\cdot(d/dt(h_n)+V_x\cdot\delta_n)$$

where:

$V_{TMn}$ represents the transverse velocity of a point M belonging to the vehicle body and located at the articulation center;

$V_{TVn}$ represents the transverse velocity of the point belonging to the track that, in the horizontal plane and when the train is stationary, coincides with the point M; and $V_x$ represents the velocity at which the train is advancing.

8. A method of controlling an actuator apparatus implemented in a suspension system of a vehicle, the vehicle comprising bodies articulated together and traveling on a track, the method comprising:

accessing an articulated architecture of the vehicle;

deriving a local curvature of the track in real time based on the articulated architecture of the vehicle; and delivering a control signal to the actuator apparatus to control the suspension system of the vehicle based on the derived local curvature of the track.

9. A method according to claim 8, wherein said control signal transmitted by said control apparatus to the actuator apparatus of a bogie of order n of the vehicle is a function of measurements of at least one deflection angle $\alpha_i$ at an articulation center situated between adjacent ones of said bodies of the vehicle and of the position offset $h_j$ of said articulation center relative to the track.

10. A method according to claim 8, wherein said actuator apparatus is force servo-controlled, said actuator apparatus sets a force applied to at least one of the bodies of the vehicle from a bogie n associated with said at least one body, and the control signal is $signal_n$ for bogie n, and is a function of an intermediate parameter $\delta_n$ that is a function of at least one deflection angle $\alpha_i$ and of at least one position offset $h_j$ of said articulation centers relative to the track, the articulation center being situated between adjacent ones of said bodies of the vehicle.

* * * * *